US006861629B2

(12) United States Patent
Dahake et al.

(10) Patent No.: US 6,861,629 B2
(45) Date of Patent: Mar. 1, 2005

(54) INDUCTION FURNACE FOR HEATING A WORKPIECE IN AN INERT ATMOSPHERE OR VACUUM

(75) Inventors: Girish Dahake, Pittsford, NY (US); Dale Wilcox, W. Henrietta, NY (US); Steve Skewes, Pittsford, NY (US)

(73) Assignee: Ameritherm, Inc., Scottsville, NY (US)

( * ) Notice: Subject to any disclaimer, the term of this patent is extended or adjusted under 35 U.S.C. 154(b) by 0 days.

(21) Appl. No.: 10/434,088

(22) Filed: May 9, 2003

(65) Prior Publication Data

US 2003/0209540 A1 Nov. 13, 2003

Related U.S. Application Data

(60) Provisional application No. 60/378,648, filed on May 9, 2002.

(51) Int. Cl.[7] ..... H05B 6/10

(52) U.S. Cl. ..... 219/635; 219/624; 219/634; 336/83

(58) Field of Search ..... 219/602, 604, 219/607, 615, 624, 634; 336/83, 90, 92, 94, 96, 98

(56) References Cited

U.S. PATENT DOCUMENTS

| | | | | |
|---|---|---|---|---|
| 4,550,412 | A | 10/1985 | Holcombe et al. | |
| 4,791,261 | A * | 12/1988 | Phinney et al. | 219/634 |
| 5,482,257 | A | 1/1996 | Holcombe et al. | |
| 5,713,979 | A | 2/1998 | Nicholson et al. | |
| 5,986,233 | A | 11/1999 | Antieau et al. | |
| 6,649,887 | B2 * | 11/2003 | Budinger | 219/615 |

* cited by examiner

*Primary Examiner*—Thor Campbell
(74) *Attorney, Agent, or Firm*—Rothwell, Figg, Ernst & Manbeck

(57) ABSTRACT

An induction furnace, according to one embodiment of the invention, includes an induction heating system and a chamber that comprises a quartz cylinder, a top cover for sealing the top end of the cylinder, and a bottom cover for sealing the bottom end of the cylinder. The induction heating system includes a power supply and a coil. The coil surrounds the chamber. Contained within the chamber is a susceptor that is susceptable to induction heating. Also contained in the chamber is a thermal insulator that is disposed between the susceptor and the inner walls of the chamber. The insulator includes a fused quartz container in which the susceptor and the workpiece are contained.

1 Claim, 2 Drawing Sheets

INDUCTION FURNACE FOR HEATING A WORKPIECE IN AN INERT ATMOSPHERE OR VACUUM

This application claims the benefit of U.S. Provisional Patent Application No. 60/378,648, filed on May 9, 2002, the contents of which are incorporated herein by reference.

BACKGROUND OF THE INVENTION

1. Field of the Invention

The present invention is related to induction furnaces for heating a workpiece in an inert atmosphere or vacuum.

2. Discussion of the Background

Conventional induction furnaces include an induction heating system and a chamber that contains a susceptor that is susceptible to induction heating. The workpiece to be heated is placed in proximity to the susceptor so that when the susceptor is inductively heated by the induction heating system the heat is transferred to the workpiece through radiation and/or conduction and convection.

In many applications it is desirable to heat the work piece in an inert atmosphere or under a high vacuum. Thus, a vacuum pump may be coupled to the chamber to reduce the air pressure within the chamber.

SUMMARY OF THE INVENTION

The present invention provides an improved induction furnace. An induction furnace, according to one embodiment of the invention, includes an induction heating system and a chamber that comprises a quartz cylinder, a top cover for scaling the top end of the cylinder, and a bottom cover for sealing the bottom end of the cylinder. The induction heating system includes a power supply and a coil. The coil surrounds the cylinder. Contained within the cylinder is a susceptor that is susceptable to induction heating. Also contained in the chamber is a thermal insulator that is disposed between the susceptor and the inner walls of the chamber. The insulator includes a fused quartz container in which the susceptor and the workpiece are contained.

Advantageously, the fused quartz container comprises two pieces, an upper piece and a lower piece. The upper piece is connected to the top cover of the quartz cylinder and the lower piece is connected to the bottom cover of the quartz cylinder. The bottom cover is releasably connected to the quartz cylinder so that it can be easily removed, thus providing a convenient mechanism for loading and unloading the workpiece.

The above and other features of the present invention, as well as the structure and operation of preferred embodiments of the present invention, are described in detail below with reference to the accompanying drawings.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements. Additionally, the left-most digit(s) of a reference number identifies the drawing in which the reference number first appears.

DETAILED DESCRIPTION OF THE PREFERRED EMBODIMENTS

While the present invention may be embodied in many different forms, there is described herein in detail an illustrative embodiment with the understanding that the present disclosure is to be considered as an example of the principles of the invention and is not intended to limit the invention to the illustrated embodiment.

Figure 1:
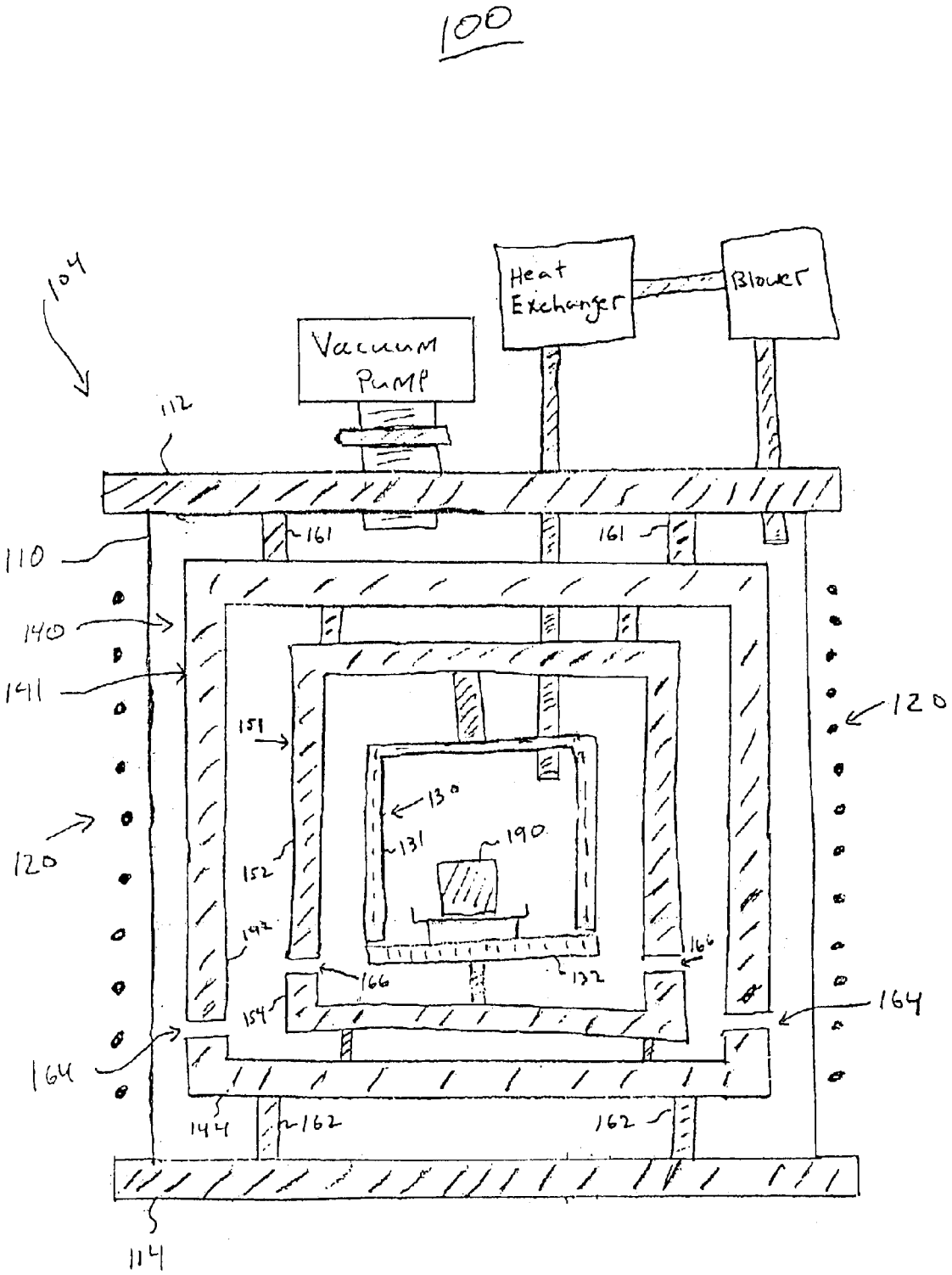
FIG. 1 is a schematic diagram of a cross section of one embodiment of the induction heating furnace.

FIG. 1 is a schematic diagram of a cross section of one embodiment of an induction heating furnace 100 according to the present invention. Induction furnace 100 includes an induction heating system and a chamber 104 that comprises a quartz cylinder 110, a first cover 112 for sealing one end of the cylinder, and a second cover 114 for sealing the second end of the cylinder. The induction heating system includes a coil 120 and a power supply (not shown) that provides an alternating current that flows through coil 120 during a heating cycle. Coil 120 is wound to form a cylindrical shape and surrounds chamber 104, as shown in FIG. 1.

Contained within chamber 104 is a susceptor 130 that is susceptable to induction heating. That is, when an alternating current flows through coil 120 an alternating magnetic field is generated, which induces currents in susceptor 130. The currents in susceptor 130 cause susceptor 130 to heat. The thermal energy that radiates from susceptor is used to heat a workpiece 190. Preferably, susceptor 130 is cylindrical, but other shapes may be used. Susceptor 130 may be any material that is susceptable to induction heating, such as, graphite, molybdenum, steel, tungsten. Preferably, the susceptor consists of molybdenum.

Also contained in chamber 104 is a thermal insulator 140 that is disposed between susceptor 130 and the inner walls of cylinder 110. In one embodiment, insulator 140 comprises a cylindrical body 141, which is made from fused quartz and in which susceptor 130 is placed. As shown in FIG. 1, insulator 140 may include additional fused quartz containers, such as second fused quartz container 151. In the embodiment shown, susceptor 130 is contained within second container 151, which itself is contained with container 141.

In one embodiment, fused quartz container 141 comprises two pieces, a first piece 142 and a second piece 144. First piece 142 is connected to first cover 112 of quartz cylinder 110 and second piece 144 is connected to second cover 114 of quartz cylinder 110. For example, ceramic posts 161 connect first piece 142 to first cover 112 and ceramic posts 162 connect second piece 144 to second cover 114. Preferably, there is a slight gap 164 between first piece 142 and second piece 144. In one embodiment, gap 164 is about 1/10 of an inch wide.

Similarly, second fused quartz container 151 comprises two pieces, a first piece 152 and a second piece 154. First piece 152 of second container 151 is connected to first piece 142 of first container 141 and second piece 154 of second container 151 is connected to second piece 144 of first container 141. Preferably, there is a slight gap 166 between first piece 152 and second piece 154. In one embodiment, gap 166 is about 1/10 of an inch wide. Preferably, as shown in FIG. 1, to prevent heat from escaping, gap 164 and gap 166 are not aligned.

Additionally, susceptor 130 may comprise two pieces, a first piece 132 and a second piece 134. First piece 132 of susceptor 130 is connected to first piece 152 of second container 151, and second piece 134 of susceptor 130 is connected to second piece 154 of second container 151. A tray 155 for supporting the workpiece 190 to be heated is connected to second piece 134 of susceptor 130. Although susceptor 130 is shown as having closed ends, this need not be the case. For example, susceptor 130 can be in the form of a tube that is open at both ends or, for example, it can comprise one or more susceptor sheets.

Figure 2:
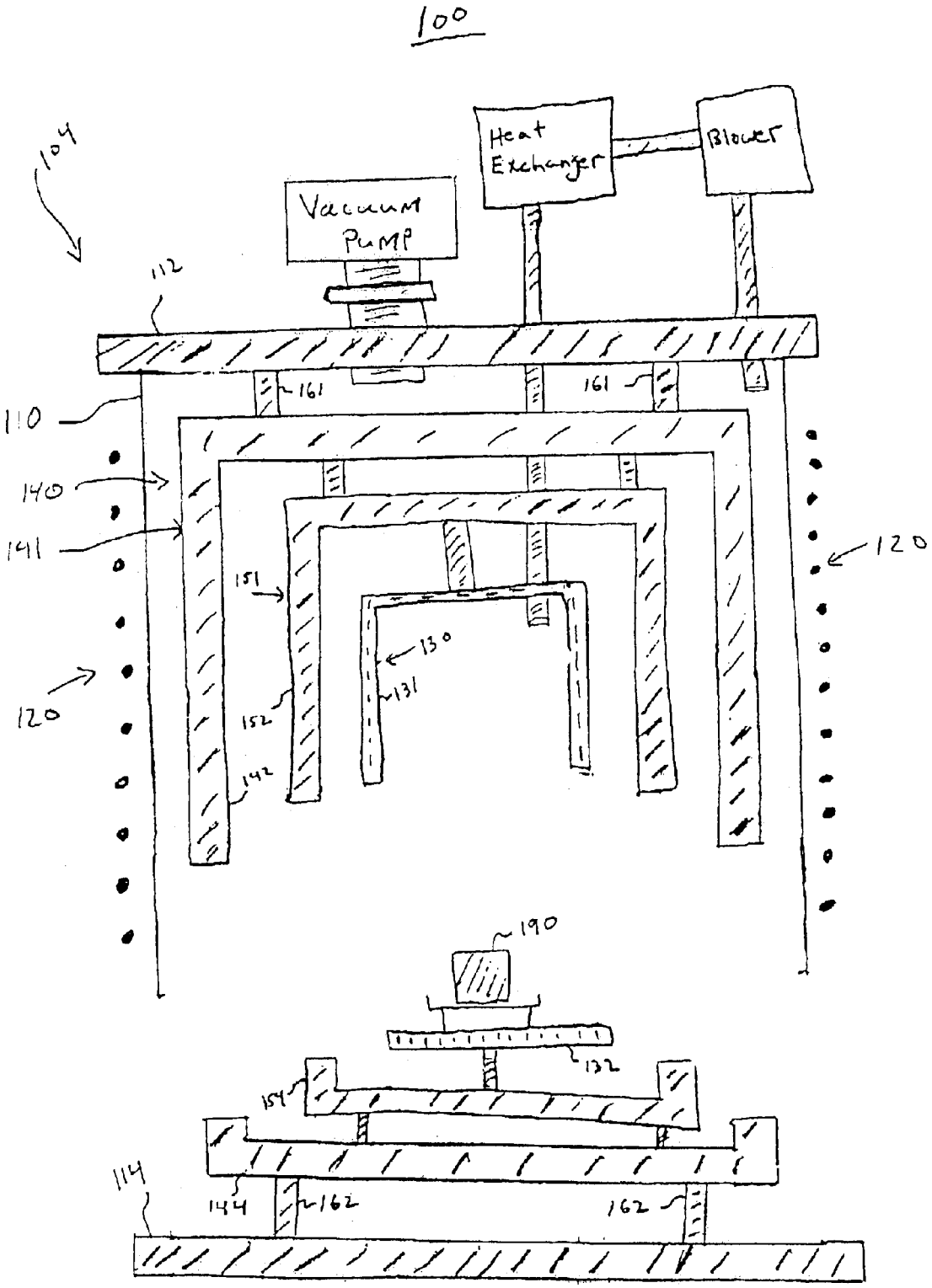
FIG. 2 is a diagram further illustrating the induction heating furnace.

At least first cover 112 or second cover 114 is releasably connected to quartz cylinder 110 so that the cover can be easily removed, thus providing a convenient mechanism for loading and unloading workpiece 190, as shown in FIG. 2.

Induction furnace 100 may also include a vacuum pump 170 for creating a vacuum within chamber 104 and a cooling system 172 for cooling chamber 104 after the workpiece has been heated as desired. Cooling system 172 may include a heat exchanger 174 and a blower 176. Hot air within chamber 104 is drawn into heat exchanger 174 and cooler air is blown back into chamber 104 by blower 174. To protect vacuum pump 170, vacuum pump 170 may be connected to chamber 104 through a gate or knife valve 178. Valve 178 shuts upon the beginning of the cooling cycle, thereby protecting pump 170.

While various illustrative embodiments of the present invention described above have been presented by way of example only, and not limitation. Thus, the breadth and scope of the present invention should not be limited by any of the above-described exemplary embodiments, but should be defined only in accordance with the following claims and their equivalents.

What is claimed is:

1. An induction heating furnace, comprising:

a cylinder having a first end and a second end;

a first cover for sealing the first end of the cylinder;

a second cover for sealing the second end of the cylinder; and a coil surrounding the cylinder, wherein, contained within the cylinder there is:

a first thermal insulating container comprising fused quartz, the first thermal insulating container comprising a first piece and a second piece, wherein the first piece is connected to the first cover and the second piece is connected to the second cover and a gap exists between the first piece and the second piece;

a second thermal insulating container comprising fused quarts, the second thermal insulating container being positioned inside of the first thermal insulating container and comprising a first piece and a second piece, wherein the first piece is connected to the first piece of the first thermal insulating container and the second piece is connected to the second piece of the first thermal insulating container and a gap exists between the first piece of the second thermal insulating container and the second piece of the second thermal insulating container; and a susceptor that is susceptable to induction heating, wherein the susceptor is placed within the second thermal insulating container, wherein the gap between the first and second piece of the first thermal insulating container is not aligned with the gap between the first and second piece of the first thermal insulating container.

* * * * *

UNITED STATES PATENT AND TRADEMARK OFFICE

CERTIFICATE OF CORRECTION

PATENT NO. : 6,861,629 B2
APPLICATION NO. : 10/434088
DATED : March 1, 2005
INVENTOR(S) : Girish Dahake et al.

It is certified that error appears in the above-identified patent and that said Letters Patent is hereby corrected as shown below:

Column 4, line 31, “piece of the first” should be --piece of the second--.

Signed and Sealed this

Twenty-fourth Day of July, 2007

JON W. DUDAS
*Director of the United States Patent and Trademark Office*